US009007282B2

(12) United States Patent
Choi

(10) Patent No.: US 9,007,282 B2
(45) Date of Patent: Apr. 14, 2015

(54) PIXEL AND ORGANIC LIGHT EMITTING DISPLAY DEVICE USING THE SAME

(75) Inventor: Sang-Moo Choi, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 537 days.

(21) Appl. No.: 12/942,969

(22) Filed: Nov. 9, 2010

(65) Prior Publication Data

US 2011/0227903 A1 Sep. 22, 2011

(30) Foreign Application Priority Data

Mar. 17, 2010 (KR) ..... 10-2010-0023760

(51) Int. Cl.
*G09G 3/32* (2006.01)

(52) U.S. Cl.
CPC ..... *G09G 3/3233* (2013.01); *G09G 3/3291* (2013.01); *G09G 2300/0819* (2013.01); *G09G 2300/0852* (2013.01); *G09G 2300/0861* (2013.01); *G09G 2310/0262* (2013.01); *G09G 2310/061* (2013.01)

(58) Field of Classification Search
USPC ..... 345/76
See application file for complete search history.

(56) References Cited

U.S. PATENT DOCUMENTS

| | | | | |
|---|---|---|---|---|
| 2005/0140600 | A1 | 6/2005 | Kim et al. | |
| 2008/0211796 | A1* | 9/2008 | Kim | 345/204 |
| 2008/0316150 | A1* | 12/2008 | Lee et al. | 345/76 |
| 2009/0243979 | A1* | 10/2009 | Kim | 345/76 |
| 2010/0134388 | A1* | 6/2010 | Maekawa et al. | 345/76 |

FOREIGN PATENT DOCUMENTS

| | | |
|---|---|---|
| JP | 2005-292272 | 10/2005 |
| KR | 10-2005-0049827 | 5/2005 |
| KR | 10-2005-0090666 A | 9/2005 |
| KR | 10-2007-0083072 A | 8/2007 |
| KR | 10-2008-0112630 A | 12/2008 |
| KR | 10-0936883 | 1/2010 |
| KR | 10-0962961 | 6/2010 |

OTHER PUBLICATIONS

Office action issued Mar. 26, 2012 for corresponding Korean Patent Application No. 10-2010-0023760, 1pg.
Korean Patent Abstracts for Korean Patent Application No. 10-2009-0131041 which published as KR 10-0936883.
Korean Patent Abstracts for Korean Patent Application No. 10-2009-0131042 which published as KR 10-0962961.

* cited by examiner

*Primary Examiner* — Long D Pham
(74) *Attorney, Agent, or Firm* — Christie, Parker & Hale, LLP

(57) ABSTRACT

A pixel has a simple structure and is capable of compensating for a threshold voltage of a driving transistor. The pixel includes: an organic light emitting diode; a second transistor coupled between a first power source and the organic light emitting diode and configured to control an amount of current flowing from the first power source to the organic light emitting diode; a first transistor coupled between a gate electrode of the second transistor and a data line and turned on when a scan signal is supplied a scan line; a third transistor coupled between the second transistor and the first power source and configured to be turned off when the first transistor is turned on and to be turned on when the first transistor is turned off; a first capacitor coupled between a gate electrode and a first electrode of the second transistor; and a second capacitor coupled between the first power source and a common node at which the first electrode of the second transistor and the first capacitor are coupled to each other.

16 Claims, 5 Drawing Sheets

PIXEL AND ORGANIC LIGHT EMITTING DISPLAY DEVICE USING THE SAME

CROSS-REFERENCE TO RELATED APPLICATION

This application claims priority to and the benefit of Korean Patent Application No. 10-2010-0023760, filed on Mar. 17, 2010, in the Korean Intellectual Property Office, the entire content of which is incorporated herein by reference.

BACKGROUND

1. Field

The present invention relates to a pixel and an organic light emitting display device using the same.

2. Description of Related Art

Recently, various flat panel displays (FPDs) having reduced weight and volume to address disadvantages of cathode ray tubes (CRTs) have been developed. The FPDs include liquid crystal display devices (LCDs), field emission display devices (FEDs), plasma display panels (PDPs), organic light emitting display devices, and the like.

Among the FPDs, the organic light emitting display devices display images using organic light emitting diodes (OLEDs) that emit light through the recombination of electrons and holes. The organic light emitting display devices have fast response speed and are driven with low power consumption.

FIG. 1 is a circuit diagram illustrating a related art pixel of a conventional organic light emitting display device. Referring to FIG. 1, a pixel 4 of the organic light emitting display device includes an OLED and a pixel circuit 2 coupled to a data line Dm and a scan line Sn to control the OLED.

An anode electrode of the OLED is coupled to the pixel circuit 2, and a cathode electrode of the OLED is coupled to a second power source ELVSS. The OLED is configured to generate light with a luminance corresponding to a current supplied from the pixel circuit 2.

The pixel circuit 2 controls the amount of current supplied to the OLED in accordance with a data signal supplied to the data line Dm when a scan signal is supplied to the scan line Sn. The pixel circuit 2 includes a second transistor M2" coupled between a first power source ELVDD and the OLED, a first transistor M1" coupled between a gate electrode of the second transistor M2" and the data line Dm, and a storage capacitor Cst" coupled between the gate electrode of the second transistor M2" and a first electrode of the second transistor M2".

A gate electrode of the first transistor M1" is coupled to the scan line Sn, and a first electrode of the first transistor M1" is coupled to the data line Dm. A second electrode of the first transistor M1" is coupled to a first terminal of the storage capacitor Cst". Here, the first electrode is a source electrode or a drain electrode, and the second electrode is the other one of the source and drain electrodes. For example, when the first electrode is the source electrode, the second electrode is the drain electrode, and vice versa. When a scan signal is supplied from the scan line Sn, the first transistor M1" is turned on in order to supply a data signal from the data line Dm to the storage capacitor Cst". At this time, a voltage corresponding to the data signal is charged in the storage capacitor Cst".

The gate electrode of the second transistor M2" is coupled to the first terminal of the storage capacitor Cst", and the first electrode of the second transistor M2" is coupled to both a second terminal of the storage capacitor Cst" and the first power source ELVDD. A second electrode of the second transistor M2" is coupled to an anode electrode of the OLED. The second transistor M2" controls an amount of current that flows from the first power source ELVDD to a second power source ELVSS via the OLED in accordance with the voltage stored in the storage capacitor Cst". At this time, the OLED emits the light corresponding to the amount of current supplied from the second transistor M2".

In an organic light emitting display device, threshold voltages of driving transistors (e.g., M2" in FIG. 1) included in respective pixels may be different from one another due to process variations and the like. When the threshold voltages of the driving transistors are different from one another, lights of different luminance are produced even though a data signal corresponding to the same gray level is supplied to each of the respective pixels. Therefore, research on ways to achieve more uniform luminescence is ongoing.

SUMMARY

Accordingly, an aspect of an embodiment according to the present invention provides a pixel having a simple structure that is capable of compensating for a threshold voltage of a driving transistor, and an organic light emitting display device using the same.

In order to achieve the foregoing and/or other aspects of the present invention, according to one embodiment of the present invention, there is provided a pixel including an organic light emitting diode, a second transistor coupled between a first power source and the organic light emitting diode and configured to control an amount of current flowing from the first power source to the organic light emitting diode, a first transistor coupled between a gate electrode of the second transistor and a data line and configured to be turned on when a scan signal is supplied to a scan line, a third transistor coupled between the second transistor and the first power source and configured to be turned off when the first transistor is turned on and to be turned on when the first transistor is turned off, a first capacitor coupled between a gate electrode of the second transistor and a first electrode of the second transistor, and a second capacitor coupled between the first power source and a common node at which the first electrode of the second transistor and the first capacitor are coupled to each other.

A capacity of the second capacitor may be larger than a capacity of the first capacitor.

The pixel may further include a fourth transistor coupled between the common node and the first electrode of the second transistor and configured to be turned off for a part of a period when the third transistor is turned off.

The fourth transistor may remain turned off until the first transistor is turned off.

According to another embodiment of the present invention, there is also provided an organic light emitting display device including a scan driver configured to supply scan signals to scan lines, a data driver configured to supply a reference voltage to data lines for a first period and to supply data signals to the data lines for a second period, and pixels positioned at crossing regions of the scan lines and the data lines, wherein each of the pixels includes an organic light emitting diode, a second transistor coupled between a first power source and the organic light emitting diode and configured to control an amount of current flowing from the first power source to the organic light emitting diode, a first transistor coupled between a gate electrode of the second transistor and a corresponding one of the data lines and configured to be turned on when a corresponding one of the scan signals is supplied to a corresponding one of the scan lines, a third transistor coupled between the second transistor and the first power source and configured to be turned off when the first transistor is turned on and to be turned on when the first transistor is turned off, a first capacitor coupled between a gate electrode of the second transistor and a first electrode of the second transistor, and a second capacitor coupled between the first power source and a common node at which the first electrode of the second transistor and the first capacitor are coupled to each other.

Gate electrodes of the third transistors may be coupled to emission control lines, and the scan driver may be configured to supply emission control signals having substantially the same width as the scan signals and voltages of a different level than the scan signals.

The reference voltage may be equal to or greater than voltages of the data signals.

The reference voltage may be less than a voltage of the first power source.

Each of the pixels may further include a fourth transistor coupled between the common node and the first electrode of the second transistor, the fourth transistor being configured to be turned off for a part of a period when the third transistor is turned off.

The fourth transistor may remain turned off until the first transistor is turned off.

The scan driver may be configured to supply control signals to control ones for the second period and gate electrodes of the fourth transistors may be coupled to the control ones.

The third transistors may be of a conductive type different than the first transistors, and gate electrodes of the third transistors may be coupled to the scan lines.

The first transistors may be NMOS transistors and the third transistors may be PMOS transistors.

The second capacitors may have a capacity larger than the first capacitors.

The first and second periods may be separate in time and the scan signals may be supplied to the scan lines for the first and second periods.

The scan driver may be configured to sequentially supply the scan signals.

According to embodiments of the present invention, the threshold voltage of the driving transistor can be compensated using a pixel having a simple structure.

BRIEF DESCRIPTION OF THE DRAWINGS

The accompanying drawings, together with the specification, illustrate exemplary embodiments of the present invention, and, together with the description, serve to explain the principles of embodiments of the present invention.

DETAILED DESCRIPTION

Figure 1:
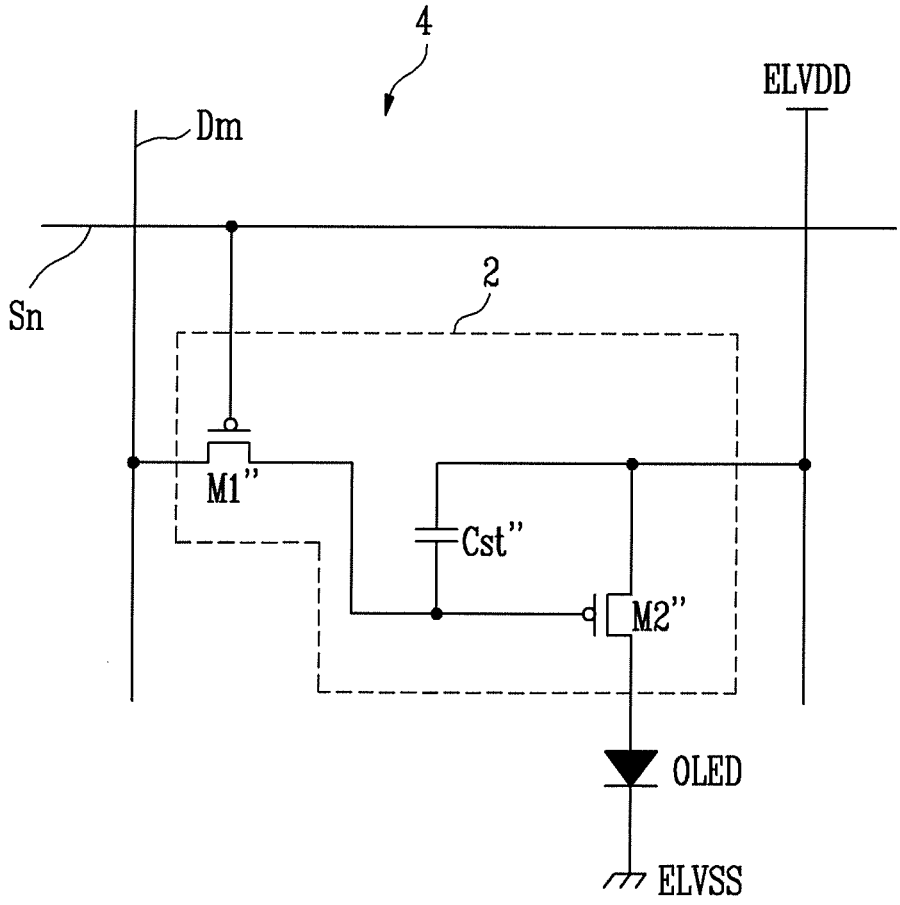
FIG. 1 (RELATED ART)
FIG. 1 is a circuit diagram illustrating a related art pixel.

Hereinafter, certain exemplary embodiments according to the present invention will be described with reference to the accompanying drawings. Here, when a first element is described as being coupled to a second element, the first element may be either directly coupled to the second element or indirectly coupled to the second element via one or more other elements. Further, some of the elements that are not essential to a complete understanding of the invention are omitted for clarity. Also, like reference numerals refer to like elements throughout.

Additional transistors have been used in pixel circuits to compensate for the threshold voltage variation of driving transistors to improve the uniformity of pixel luminescence. A structure in which six transistors and one capacitor are included in each of the pixels to compensate for the threshold voltage of the driving transistor has been suggested (Korean Unexamined Patent Application Publication No. 2007-0083072). However, when six transistors are included in each of the pixels, probability of defects increases, and a yield is therefore reduced. Also, since such pixels might be coupled to four signal lines, an aperture ratio is decreased, and design is more complicated.

Hereinafter, exemplary embodiments of the present invention are described in detail with reference to FIGS. 2 to 8.

Figure 2:
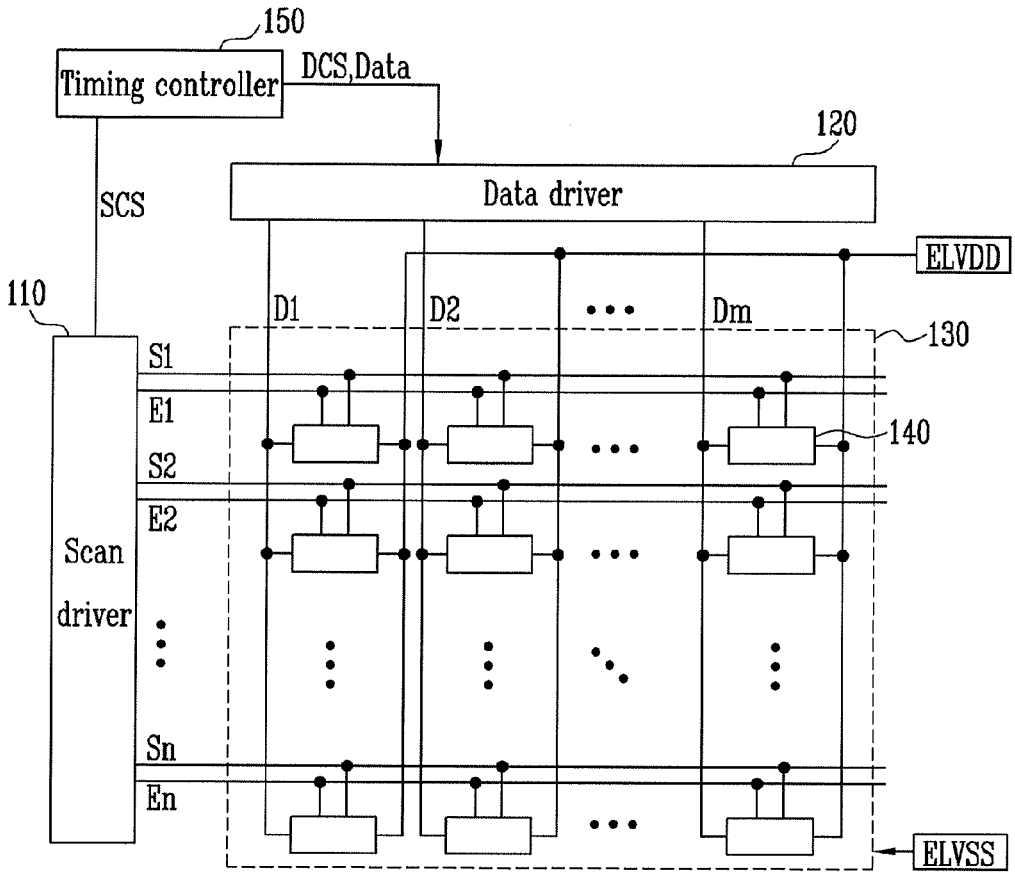
FIG. 2 is a block diagram illustrating an organic light emitting display device according to an embodiment of the present invention.

FIG. 2 is a block diagram of an organic light emitting display device according to an embodiment of the present invention.

Referring to FIG. 2, the organic light emitting display device according to one embodiment of the present invention includes a display unit 130 including pixels 140 positioned at crossing regions of scan lines S1 to Sn, emission control lines E1 to En, and data lines D1 to Dm, a scan driver 110 for driving the scan lines S1 to Sn and the emission control lines E1 to En, a data driver 120 for driving the data lines D1 to Dm, and a timing controller 150 for controlling the scan driver 110 and the data driver 120.

The scan driver 110 receives a scan drive control signal SCS supplied from the timing controller 150. The scan driver 110 then generates scan signals and supplies (e.g., sequentially supplies) the generated scan signals to the scan lines S1 to Sn, and also generates emission control signals and supplies (e.g., sequentially supplies) the generated emission control signals to the emission control lines E1 to En.

Figure 4:
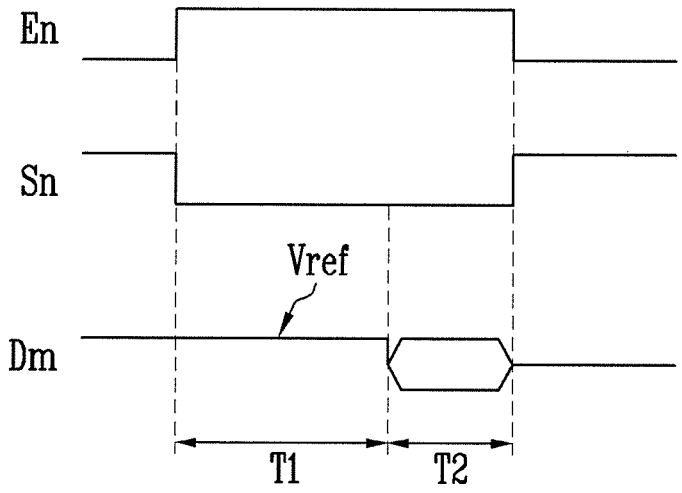
FIG. 4 is a waveform diagram illustrating a driving method of the embodiment of the pixel shown in FIG. 3.

Here, the emission control signal supplied to an $i^{th}$ ("i" is a positive integer) emission control line Ei may overlap the scan signal supplied to the $i^{th}$ scan line Si during a partial period. Here, as shown in FIG. 4, the scan signals Sn and the emission control signals En may completely overlap in time. For example, the emission control signal supplied to the $i^{th}$ emission control line Ei has the same width as that of the scan signal supplied to the $i^{th}$ scan line Si at the same time or at substantially the same time. In one embodiment, the scan signal and the emission control signal are set to have voltages of different levels (e.g., different polarities). For example, the scan signal may be a low level signal and the emission control signal may be a high level signal.

The data driver 120 receives a data drive control signal DCS supplied from the timing controller 150. The data driver 120 then generates data signals and supplies a reference voltage, as well as data signals, to the data lines D1 to Dm. Here, the data driver 120 supplies the reference voltage to the data lines D1 to Dm for a first period and supplies the data signals to the data lines for a second period, which is separate in time from the first period. The first and second periods together may form a period when the scan signals are supplied. Here, the reference voltage may be equal to or higher than a voltage of the data signal. In addition, the reference voltage may be lower than a voltage of the first power source ELVDD.

The timing controller 150 generates the data drive control signal DCS and the scan drive control signal SCS in response to externally supplied synchronization signals. The data drive control signal DCS is supplied to the data driver 120, and the scan drive control signal SCS is supplied to the scan driver 110. The timing controller 150 supplies externally supplied data Data to the data driver 120.

The display unit 130 receives a first power from a first power source ELVDD (e.g., an external first power source ELVDD) and a second power from a second power source ELVSS (e.g., an external second power source ELVSS) and supplies the first and second powers to each of the pixels 140. Each of the pixels 140 that receives the first and second powers may generate light corresponding to the data signals.

Figure 3:
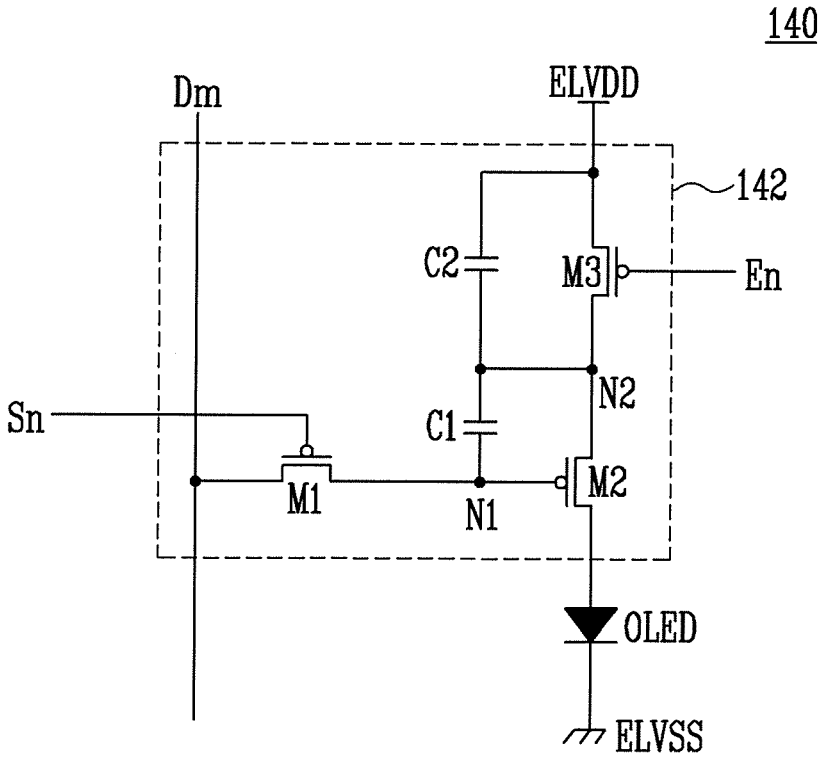
FIG. 3 is a circuit diagram illustrating an embodiment of a pixel shown in FIG. 2.

FIG. 3 is a circuit diagram illustrating one embodiment of the pixel shown in FIG. 2. For convenience of illustration, the pixel 140 coupled to the $n^{th}$ scan line Sn and the $m^{th}$ data line Dm is shown ("n" and "m" are positive integers).

Referring to FIG. 3, the pixel 140 according to one embodiment of the present invention includes an OLED and a pixel circuit 142 coupled to the data line Dm, the scan line Sn, and the emission control line En, so as to control the amount of current supplied to the OLED.

An anode electrode of the OLED is coupled to the pixel circuit 142, and a cathode electrode of the OLED is coupled to the second power source ELVSS. The OLED generates light (e.g., with predetermined brightness) corresponding to current supplied from the pixel circuit 142. Here, the second power source ELVSS is set to a voltage lower than the first power source ELVDD.

The pixel circuit 142 controls the amount of current supplied from the first power source ELVDD to the second power source ELVSS via the OLED in response to a data signal. To this end, the pixel circuit 142 includes a first transistor M1, a second transistor M2, a third transistor M3, a first capacitor C1, and a second capacitor C2.

A first electrode of the first transistor M1 is coupled to the data line Dm and a second electrode of the first transistor M1 is coupled to a first node N1. A gate electrode of the first transistor M1 is coupled to the scan line Sn. The first transistor M1 is turned on when a scan signal is supplied to the scan line Sn, and either supplies the reference voltage, or supplies the data signal that is supplied to the data line Dm, to the first node N1.

A first electrode of the second transistor M2 is coupled to a second electrode of the third transistor M3 at a second node N2, and a second electrode of the second transistor M2 is coupled to an anode electrode of the OLED. A gate electrode of the second transistor M2 is coupled to the first node N1. The second transistor M2 supplies current corresponding to a voltage of the first node N1 to the OLED.

A first electrode of the third transistor M3 is coupled to the first power source ELVDD, and a second electrode of the third transistor M3 is coupled to the second node N2. A gate electrode of the third transistor M3 is coupled to the emission control line En. The third transistor M3 is turned off when an emission control signal is supplied to the emission control line En, and the third transistor M3 is turned on when an emission control signal is not supplied to the emission control line En.

The first capacitor C1 is coupled between the first node N1 and the second node N2. The first capacitor C1 stores a voltage corresponding to a data signal and a threshold voltage of the second transistor M2.

The second capacitor C2 is coupled between the first power source ELVDD and the second node N2. The second capacitor C2 sets a voltage variation of the first node N1 to be different from a voltage variation of the second node N2 such that the voltage corresponding to the data signal can be charged to the first capacitor C1. To this end, in the described embodiment, the second capacitor C2 has a larger capacity than that of the first capacitor C1.

FIG. 4 is a waveform diagram illustrating a driving method of the embodiment of the pixel shown in FIG. 3. For the sake of convenience, the period when the scan signal is supplied is divided into a first period T1 and a second period T2.

Referring to FIG. 4, a scan signal is supplied to the scan line Sn and an emission control signal is supplied to the emission control line En for the first and second periods T1 and T2. The reference voltage Vref is supplied to the data line Dm for the first period T1.

When the emission control signal is supplied to the emission control line En, the third transistor M3 is turned off. When the scan signal is supplied to the scan line Sn, the first transistor M1 is turned on. When the first transistor M1 is turned on, the reference voltage Vref is supplied to the first node N1. When the reference voltage Vref is supplied to the first node N1, the second node N2 is lowered from the voltage of the first power source ELVDD to a voltage of (Vref+|(Vth (M2)|), which represents adding the threshold voltage of the second transistor M2 to the reference voltage Vref. At this time, the first capacitor C1 stores a voltage corresponding to the threshold voltage of the second transistor M2.

For the second period T2, the data signal is supplied to the data line Dm. When the data signal is supplied to the data line Dm, the voltage of the first node N1 varies from the reference voltage Vref to the voltage of the data signal. For example, the voltage of the first node N1 may be lowered from the reference voltage Vref to the voltage of the data signal.

When the voltage of the first node N1 varies, the voltage of the second node N2 varies corresponding to the voltage variation of the first node N1. Due to the selected properties of the second capacitor C2, the voltage variation of the second node N2 is set to be smaller than that of the first node N1. The larger the capacity of the capacitor C2 in comparison to the capacity of the capacitor C1, the smaller the voltage variation of the node N2.

In an embodiment of the present invention, if the first capacitor C1 has the same capacity as that of the second capacitor C2, the voltage between the gate electrode and the first electrode of the second transistor M2 for the second period T2 is determined by equation 1.

$$V_{gs}(M2)=|V_{th}(M2)|+C2/(C1+C2)\times\Delta V \qquad \text{Equation 1}$$

In Equation 1, ΔV is a voltage difference corresponding to voltage variations of the first node N1 and the second node N2 when the data signal is supplied.

After the second period T2, the supply of the scan signal to the scan line Sn and the supply of the emission control signal to the emission control line En are stopped. When the supply of the scan signal to the scan line Sn is stopped, the first transistor M1 is turned off. When the supply of the emission control signal to the emission control line En is stopped, the third transistor M3 is turned on. At this time, the second transistor M2 controls the amount of current supplied to the OLED in accordance with the voltage between the gate electrode and the first electrode of the second transistor M2, which is represented by Equation 2.

$$I_{oled}=\beta(V_{gs}(M2)-|V_{th}(M2)|)^2=\beta(|V_{th}(M2)|+C2/(C1+C2)\times\Delta V-|V_{th}(M2|)^2=\beta(C2/(C1+C2)\times\Delta V)^2 \quad \text{Equation 2}$$

Referring to Equation 2,the current supplied to the OLED is determined independently of the threshold voltage of the second transistor M2, and an image with uniform brightness can be displayed.

Figure 5:
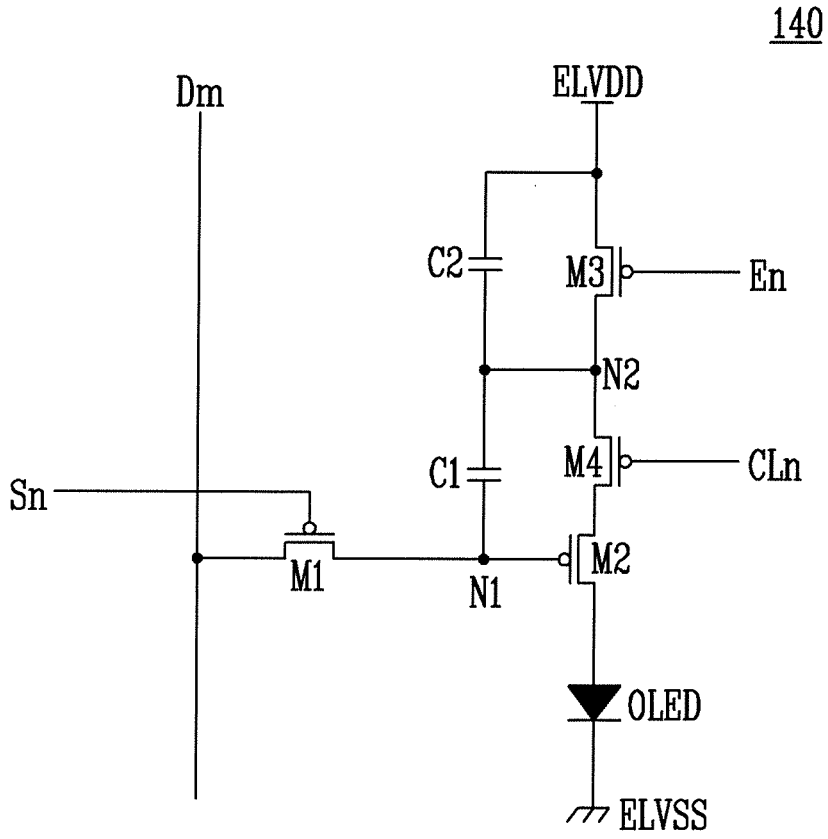
FIG. 5 is a circuit diagram illustrating another embodiment of a pixel shown in FIG. 2.
Figure 6:
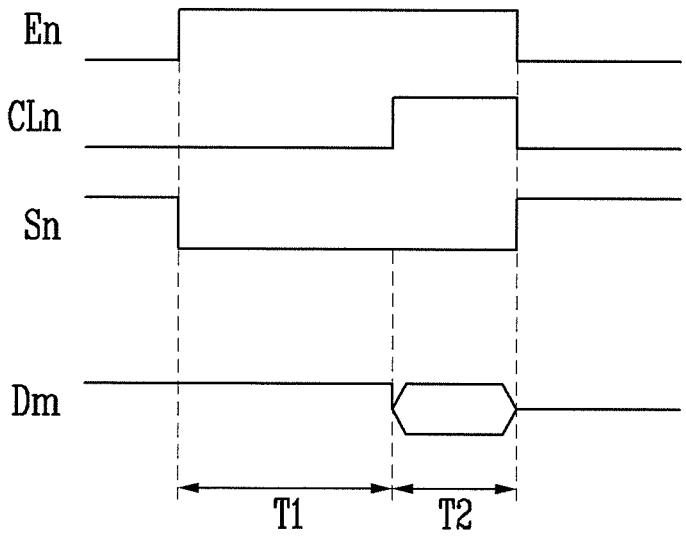
FIG. 6 is a waveform diagram illustrating a driving method of the embodiment of the pixel shown in FIG. 5.

FIG. 5 is a circuit diagram illustrating a pixel according to another embodiment of the present invention. In the description with reference to FIG. 5, same reference numerals are assigned to the same elements as those in FIG. 3, and description thereof will be omitted. FIG. 6 is a waveform diagram illustrating a driving method of the embodiment of the pixel of FIG. 5.

Referring to FIGS. 5 and 6, a pixel 140 according to another embodiment of the present invention further includes a fourth transistor M4 coupled between the second node N2 and the first electrode of the second transistor M2. A gate electrode of the fourth transistor M4 is coupled to a control line CLn, and is turned off when a control signal is supplied to the control line CLn. Here, the control signal is supplied to the control line CLn (for example, supplied from the scan driver 110) for a second period T2.

The first capacitor C1 charges a voltage corresponding to the threshold voltage of the second transistor M2 for the first period T1. The fourth transistor M4 is turned off by the control signal supplied to the control line CLn for the second period T2.

The first capacitor C1 is charged with a voltage corresponding to Equation 1 for the second period T2. Here, since the fourth transistor M4 is off, the current does not flow from the second node N2 to the OLED via the second transistor M2. That is, since the electrical connection between the second node N2 and the second transistor M2 is interrupted by the fourth transistor M4, a desired voltage can be charged to the first capacitor C1 (e.g., the desired voltage may be stably charged to the first capacitor).

After the second period T2, the third transistor M3 and the fourth transistor M4 are turned on. When the third transistor M3 and the fourth transistor M4 are turned on, the second transistor M2 supplies current corresponding to Equation 2 to the OLED.

Figure 7:
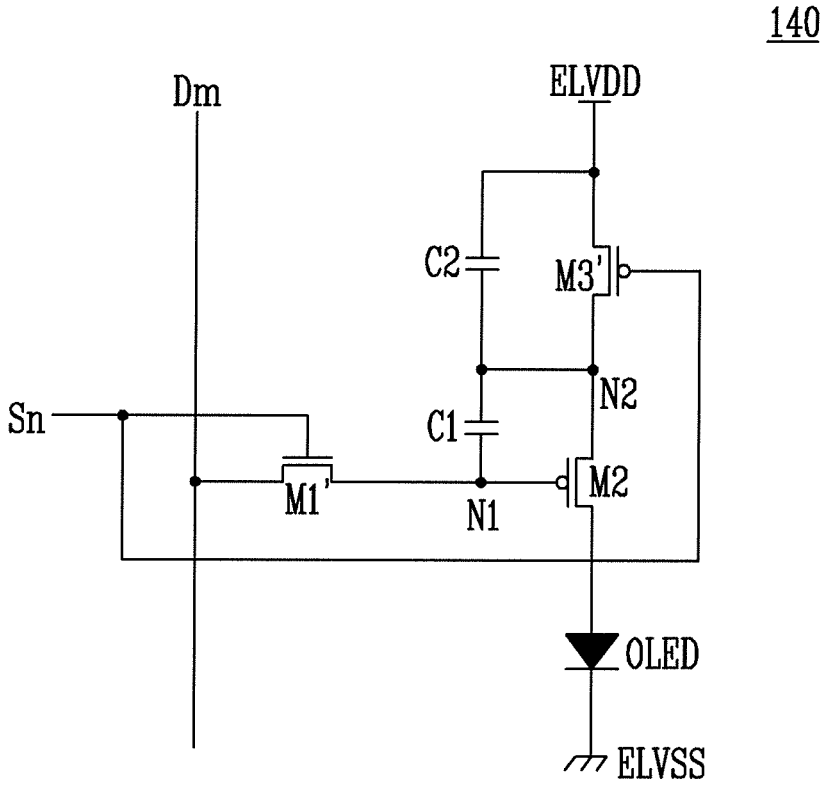
FIG. 7 is a circuit diagram illustrating yet another embodiment of a pixel shown in FIG. 2.
Figure 8:
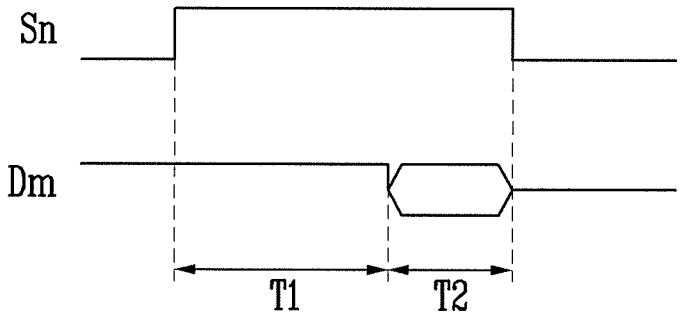
FIG. 8 is a waveform diagram illustrating a driving method of the embodiment of the pixel shown in FIG. 7.

FIG. 7 is a circuit diagram illustrating a pixel according to yet another embodiment of the present invention. In the description with reference to FIG. 7, same reference numerals are assigned to the same elements as those in FIGS. 3 and 5, and description thereof will be omitted. FIG. 8 is a waveform diagram illustrating a driving method of the embodiment of the pixel of FIG. 7.

Referring to FIG. 7, a pixel 140 according to yet another embodiment of the present invention includes a third transistor M3' coupled between the second node N2 and the first power source ELVDD and a first transistor M1' coupled between the first node N1 and the data line Dm.

The first transistor M1' may be an NMOS transistor that is turned on when the scan signal is supplied to the scan line Sn. To this end, the scan signal may be set as a high level voltage.

The third transistor M3' may be a PMOS transistor that is turned off when a scan signal is supplied to the scan line Sn.

Additionally referring to FIG. 8, the first transistor M1' is turned on and the third transistor M3' is turned off by the scan signal supplied to the scan line Sn for a first period T1. When the first transistor M1' is turned on, a voltage corresponding to the threshold voltage of the second transistor M2 is charged to the first capacitor C1 by the reference voltage Vref supplied to the data line Dm for the first period T1.

A data signal is supplied to the data line Dm for a second period T2. When the data signal is supplied to the data line Dm, the first capacitor C1 is further charged with a voltage corresponding to the data signal due to a voltage difference between the first node N1 and the second node N2.

After that, the supply of the scan signal to the scan line Sn is stopped, the first transistor M1' is turned off, and the third transistor M3' is turned on. When the third transistor M3' is turned on, the first power source ELVDD is electrically coupled to the second node N2. At this time, the second transistor M2 supplies a current corresponding to Equation 2 to the OLED.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A pixel comprising:

an organic light emitting diode;

a second transistor coupled between a first power source and the organic light emitting diode and configured to control an amount of current flowing from the first power source to the organic light emitting diode;

a first transistor coupled between a gate electrode of the second transistor and a data line and configured to be turned on when a scan signal is supplied to a scan line, wherein a first electrode of the first transistor is directly connected to the gate electrode of the second transistor;

a third transistor coupled between the second transistor and the first power source and configured to be turned off when the first transistor is turned on and to be turned on when the first transistor is turned off;

a first capacitor coupled between the gate electrode of the second transistor and a first electrode of the second transistor;

a fourth transistor comprising a gate electrode, a first electrode directly connected to a first capacitor at a common node, and a second electrode coupled to the first electrode of the second transistor, the fourth transistor being configured to control the amount of current flowing from the first power source to the organic light emitting diode; and a second capacitor coupled to the first power source and connected directly to the common node at which the first electrode of the fourth transistor and the first capacitor are directly connected to each other.

2. The pixel as claimed in claim 1, wherein a capacity of the second capacitor is larger than a capacity of the first capacitor.

3. The pixel as claimed in claim 1, wherein the fourth transistor is configured to be turned off for a part of a period when the third transistor is turned off.

4. The pixel as claimed in claim 3, wherein the fourth transistor remains turned off until the first transistor is turned off.

5. An organic light emitting display device comprising:

a scan driver configured to supply scan signals to scan lines;

a data driver configured to supply a reference voltage to data lines for a first period and to supply data signals to the data lines for a second period; and pixels positioned at crossing regions of the scan lines and the data lines, wherein each of the pixels comprises:

an organic light emitting diode;

a second transistor coupled between a first power source and the organic light emitting diode and configured to control an amount of current flowing from the first power source to the organic light emitting diode, wherein a first electrode of the first transistor is directly connected to a gate electrode of the second transistor;

a first transistor coupled between the gate electrode of the second transistor and a corresponding one of the data lines and configured to be turned on when a corresponding one of the scan signals is supplied to a corresponding one of the scan lines;

a third transistor coupled between the second transistor and the first power source and configured to be turned off when the first transistor is turned on and to be turned on when the first transistor is turned off;

a first capacitor coupled between the gate electrode of the second transistor and a first electrode of the second transistor;

a fourth transistor comprising a gate electrode, a first electrode directly connected to a first capacitor at a common node, and a second electrode coupled to the first electrode of the second transistor, the fourth transistor being configured to control the amount of current flowing from the first power source to the organic light emitting diode; and a second capacitor coupled to the first power source and connected directly to the common node at which the first electrode of the fourth transistor and the first capacitor are directly connected to each other.

6. The organic light emitting display device as claimed in claim 5, wherein gate electrodes of the third transistors are coupled to emission control lines, and the scan driver is configured to supply emission control signals having substantially a same width as the scan signals and voltages of a different level than the scan signals.

7. The organic light emitting display device as claimed in claim 5, wherein the reference voltage is equal to or greater than voltages of the data signals.

8. The organic light emitting display device as claimed in claim 5, wherein the reference voltage is less than a voltage of the first power source.

9. The organic light emitting display device as claimed in claim 5, wherein the fourth transistor is configured to be turned off for a part of a period when the third transistor is turned off.

10. The organic light emitting display device as claimed in claim 9, wherein the fourth transistor remains turned off until the first transistor is turned off.

11. The organic light emitting display device as claimed in claim 9, wherein the scan driver is configured to supply control signals to control lines for the second period and gate electrodes of the fourth transistors are coupled to the control lines.

12. The organic light emitting display device as claimed in claim 5, wherein the third transistors are of a conductive type different than the first transistors, and gate electrodes of the third transistors are coupled to the scan lines.

13. The organic light emitting display device as claimed in claim 12, wherein the first transistors are NMOS transistors and the third transistors are PMOS transistors.

14. The organic light emitting display device as claimed in claim 5, wherein the second capacitors have a capacity larger than the first capacitors.

15. The organic light emitting display device as claimed in claim 5, wherein the first and second periods are separate in time and the scan signals are supplied to the scan lines for the first and second periods.

16. The organic light emitting display device as claimed in claim 5, wherein the scan driver is configured to sequentially supply the scan signals.

* * * * *